US009182127B2

(12) United States Patent
Freeman et al.

(10) Patent No.: US 9,182,127 B2
(45) Date of Patent: Nov. 10, 2015

(54) HOME APPLIANCE WITH IMPROVED CONTROL ACCESS

(71) Applicant: BSH Home Appliances Corporation, Irvine, CA (US)

(72) Inventors: John Freeman, Knoxville, TN (US); Samuel Harward, Knoxville, TN (US); Jeremiah Nash, Knox, TN (US); Michael Rutherford, Duff, TN (US)

(73) Assignee: BSH Home Appliances Corporation, Irvine, CA (US)

( * ) Notice: Subject to any disclaimer, the term of this patent is extended or adjusted under 35 U.S.C. 154(b) by 445 days.

(21) Appl. No.: 13/735,284

(22) Filed: Jan. 7, 2013

(65) Prior Publication Data

US 2014/0191639 A1 Jul. 10, 2014

(51) Int. Cl.

| | |
|---|---|
| ***F24C 1/00*** | (2006.01) |
| ***F24C 15/00*** | (2006.01) |
| ***F24C 7/08*** | (2006.01) |
| ***F24C 3/12*** | (2006.01) |
| ***F24C 15/08*** | (2006.01) |

(52) U.S. Cl.

CPC ..... *F24C 7/082* (2013.01); *F24C 3/124* (2013.01); *F24C 3/126* (2013.01); *F24C 15/08* (2013.01)

(58) Field of Classification Search

CPC ..... F24C 7/081; F24C 7/082; F24C 7/083; F24C 7/086; F24C 7/08; F24C 3/12; F24C 3/122; F24C 3/124; F24C 3/126; F24C 3/128; D06F 39/005; D06F 33/02; A47L 15/4293

See application file for complete search history.

(56) References Cited

U.S. PATENT DOCUMENTS

| | | | | |
|---|---|---|---|---|
| 3,033,188 | A * | 5/1962 | Cline et al. | 126/19 R |
| 3,818,890 | A * | 6/1974 | Evans et al. | 126/200 |
| 4,964,393 | A * | 10/1990 | Knudsen | 126/211 |
| 2010/0025214 | A1 * | 2/2010 | Roose et al. | 200/5 A |

* cited by examiner

*Primary Examiner* — David J Laux

(74) *Attorney, Agent, or Firm* — James E. Howard; Andre Pallapies

(57) ABSTRACT

A home appliance defining a width direction and a depth direction, and a control panel extending along the width direction, the control panel having control element components mounted thereat, the home appliance including a chassis within the body adjacent the control panel; first and second spaced brackets mounted to the chassis adjacent the control panel, with fastener portions aligned in the depth direction; and a cross member extending in the width direction between the first bracket and the second bracket with control elements intermediate the cross member and the chassis, the cross member having a fastener portion at each widthwise end thereof and aligned in the depth direction, the cross member being mounted to the first bracket using fasteners aligned in the depth direction, and the second bracket using fasteners aligned in the depth direction, wherein the fasteners are removable from the depth direction.

29 Claims, 6 Drawing Sheets

HOME APPLIANCE WITH IMPROVED CONTROL ACCESS

BACKGROUND OF THE INVENTION

Cooking appliances for domestic use, including ranges, may have generally square or rectangular bodies that are installed in openings of predetermined size within a kitchen cabinet structure. FIG. 1 illustrates such a range 10 that is mounted in an opening between left cabinets CL and right cabinets CR. The range 10 occupies and defines a width dimension, a depth dimension and a height dimension to fill the 3-dimensional spaced between the cabinets CL, CR. Of interest to the present invention are the width dimension and the depth dimension, each of which gives rise to a width direction and a depth direction respectively.

The range 10 may be capped with a cooktop 14 on an upper portion of the range body 12 at approximately cabinet level height. The cooktop 14 has a number of burners thereon and grates 16 over the burners to support cooking vessels for surface cooking. The burners are controlled by control elements 26 mounted in association with a control panel 24 which extends in the width direction along the front portion of the range 10. The control elements 26 may include dials for burner control as well as indicator lamps and timers or clocks.

FIG. 2 illustrates a prior art range 100 with the cooktop removed, revealing the internal structure of the range 100 in an area near the control panel 124. Control element components 134 are mounted to an internal chassis 130 behind the control panel 124. A cross member 150 extends behind the control element components 134 in the width direction and is mounted to a chassis 130 that provides the internal structure of the range 100 with mounting locations and support. The cross member 150 helps to stiffen the chassis structure 130 of the range 100 adjacent the control panel 124, an area of user interactivity with the range.

During times of inspection, maintenance and/or repair, access may be needed to the control elements 134 having control element components 136 which necessitates removing the cross member 150. Prior ranges have the cross member 150 mounted to the chassis using fasteners 148 that are accessible from a width direction W. Such an orientation requires that the range body 12 be removed from or extended substantially from its opening in the cabinets so that a fastener removal tool such as a screwdriver or other form of driver may gain purchase on the fasteners for the removal.

Even though field repairs are irregular occurrences, it would be beneficial if, under such conditions described above, the cross member could be removed from behind the control element components in a matter that does not require extension or removal of the range from the opening in the cabinets.

SUMMARY OF THE INVENTION

To that end, the present invention provides a mounting arrangement for a cross member within the range that is fastened to the chassis using fasteners that are accessible without extension or removal of a range from the opening provided in the cabinetry.

The present invention also provides a removable cross member wherein the fasteners holding the cross member in place are accessible in a depth direction with respect to the range body.

In addition, the present invention provides a cross member assembly for installation in existing home appliances for improved control element component access.

To those ends, the present invention is directed to a home appliance having an appliance body defining a width direction and a depth direction, and a control panel located at a front portion of the appliance body and extending along the width direction. The control panel has a plurality of control elements including control element components mounted thereat for operational control of the home appliance. The home appliance includes a chassis within the body adjacent the control panel with control element components mounted thereto. A first bracket is mounted to the chassis adjacent the control panel, with the first bracket having a first fastener portion aligned in the depth direction. A second bracket is mounted to the chassis adjacent the control panel at a spacing from the first bracket, with the second bracket having a second fastener portion aligned in the depth direction. A cross member extends in the width direction between the first bracket and the second bracket with control elements intermediate the cross member and the chassis, the cross member having a fastener portion at each widthwise end thereof and aligned in the depth direction. The cross member is mounted to the first bracket using fasteners aligned in the depth direction, and the second bracket using fasteners aligned in the depth direction, wherein the fasteners are removable from the depth direction.

Preferably, the first bracket and the second bracket are mounted to the chassis using rivets and the cross member is mounted to the first bracket and the second bracket using screws, with the screws being aligned in the depth direction It is preferred that the first bracket is mounted to the chassis adjacent a first side of the appliance body and the second bracket is mounted to the chassis adjacent a second side of the appliance body wherein the cross member extends between the first side of the appliance body and the second side of the appliance body and the cross member extends substantially the width of the control panel.

It is further preferred that the first bracket and the second bracket are generally L-shaped in cross section. Preferably, the first bracket and the second bracket include two wall portions attached along sides thereof with one wall portion abutting the chassis and the other wall portion having the cross member mounted thereto. It is further preferred that the first bracket and the second bracket wall portions include one wall portion aligned in the depth direction and the other wall portion aligned in the width direction.

Preferably, the first fastener portion of the first bracket is formed on the wall portion of the first bracket aligned in the width direction, and the second fastener portion of the second bracket is formed on the wall portion of the second bracket aligned in the width direction. It is preferred that the cross member is generally planar.

The present invention is also directed to a range. To that end, the present invention is directed to a range having a range body defining a width direction and a depth direction, and a control panel located at a front portion of the range body and extending along the width direction. The control panel has a plurality of control elements including control element components mounted thereat for operational control of the range. The range includes a chassis within the body adjacent the control panel with control element components mounted thereto. A first bracket is mounted to the chassis adjacent the control panel, with the first bracket having a first fastener portion aligned in the depth direction. A second bracket is mounted to the chassis adjacent the control panel at a spacing from the first bracket, with the second bracket having a second fastener portion aligned in the depth direction. A cross member extends in the width direction between the first bracket and the second bracket with control elements intermediate the cross member and the chassis, the cross member having a fastener portion at each widthwise end thereof and aligned in the depth direction. The cross member is mounted to the first bracket using fasteners aligned in the depth direction, and the second bracket using fasteners aligned in the depth direction, wherein the fasteners are removable from the depth direction.

Preferably, the first bracket and the second bracket are mounted to the chassis using rivets and the cross member is mounted to the first bracket and the second bracket using screws, with the screws being aligned in the depth direction It is preferred that the first bracket is mounted to the chassis adjacent a first side of the range body and the second bracket is mounted to the chassis adjacent a second side of the range body wherein the cross member extends between the first side of the range body and the second side of the range body and the cross member extends substantially the width of the control panel.

It is further preferred that the first bracket and the second bracket are generally L-shaped in cross section. Preferably, the first bracket and the second bracket include two wall portions attached along sides thereof with one wall portion abutting the chassis and the other wall portion having the cross member mounted thereto. It is further preferred that the first bracket and the second bracket wall portions include one wall portion aligned in the depth direction and the other wall portion aligned in the width direction.

Preferably, the first fastener portion of the first bracket is formed on the wall portion of the first bracket aligned in the width direction, and the second fastener portion of the second bracket is formed on the wall portion of the second bracket aligned in the width direction. It is preferred that the cross member is generally planar.

The present invention can also appear in a form for retrofitting existing ranges for improved control access. To that end, the present invention is directed to a cross member assembly for mounting to a home appliance having an appliance body defining a width direction and a depth direction; a control panel located at a front portion of the appliance body and extending along the width direction, the control panel having a plurality of control element components mounted thereat for operational control of the home appliance; and a chassis within the body adjacent the control panel with control element components mounted thereto. The cross member assembly includes a first bracket for mounting to the chassis adjacent the control panel, the first bracket having a first fastener portion aligned in the depth direction; a second bracket for mounting to the chassis adjacent the control panel at a spacing from the first bracket, the second bracket having a second fastener portion aligned in the depth direction; and a cross member configured to extend in the width direction between the first bracket and the second bracket. The cross member has a fastener portion at each widthwise end thereof and aligned in the depth direction, and is configured for mounting to the first bracket using fasteners aligned in the depth direction, and to the second bracket using fasteners aligned in the depth direction, wherein the fasteners are removable from the depth direction.

Preferably, the first bracket and the second bracket are generally L-shaped in cross section. It is preferred that the first bracket and the second bracket include two wall portions attached along sides thereof with one wall portion abutting the chassis and the other wall portion having the cross member mounted thereto. It is further preferred that the first bracket and the second bracket wall portions include one wall portion aligned in the depth direction and the other wall portion aligned in the width direction.

It is preferred that the first fastener portion of the first bracket is formed on the wall portion of the first bracket aligned in the width direction, and that the second fastener portion of the second bracket is formed on the wall portion of the second bracket aligned in the width direction. Preferably, the cross member is generally planar.

By the above, the present invention provides a home appliance, particularly a range, with enhanced serviceability by easing access to control panel components. In addition, the present invention provides a cross member assembly that can be retrofitted to existing home appliances, such as ranges for improved control access.

DESCRIPTION OF THE PREFERRED EMBODIMENT

Figure 1:
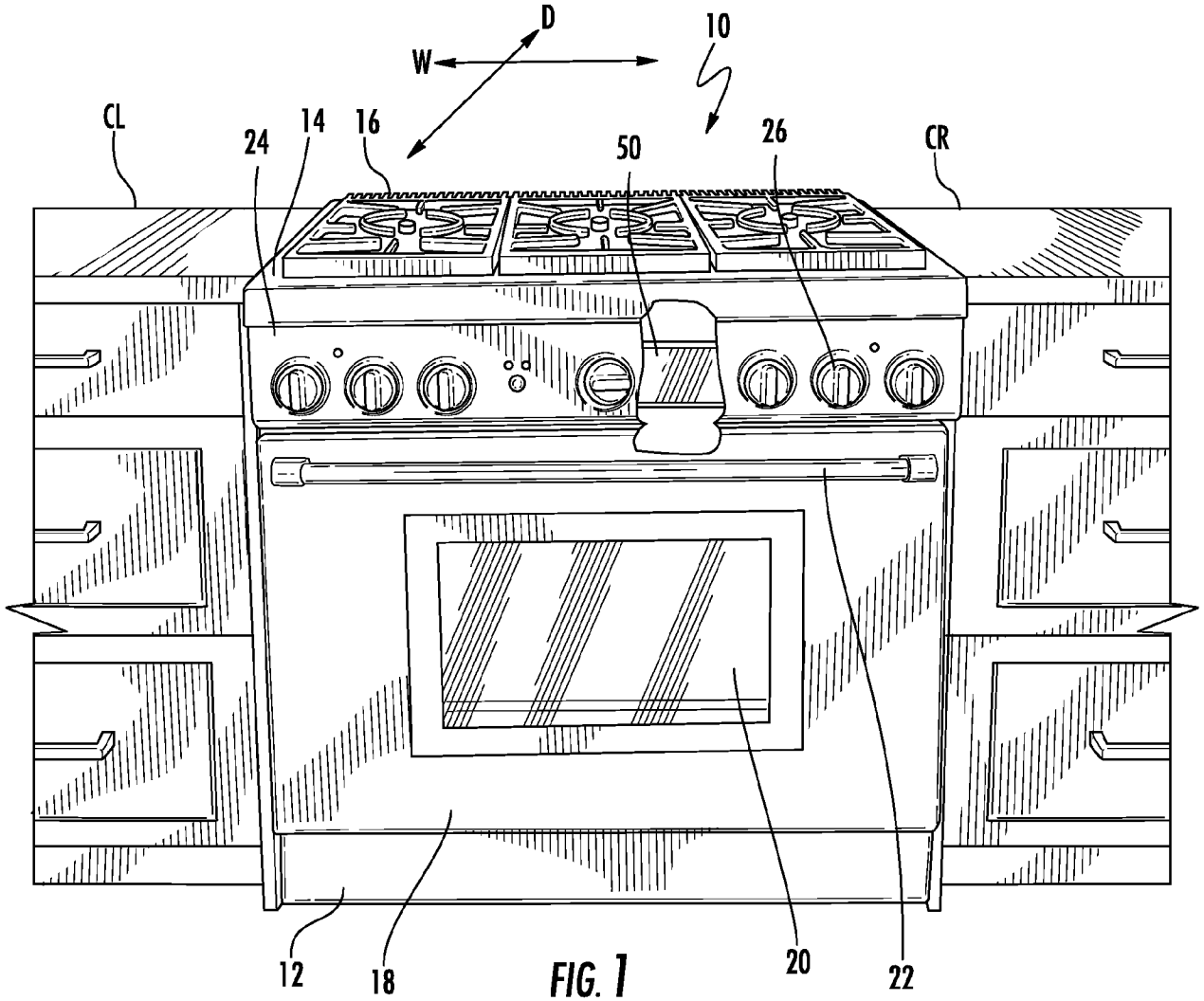
FIG. 1 is a front view of a home appliance in the form of a range according to a preferred embodiment of the present invention with the range broken open to illustrate the location of the cross member.

Turning now to the drawings and, more particularly to FIG. 1, a home appliance in the form of a range is illustrated generally at 10 and includes a generally square or rectangular range body 12 capped with a generally planar cooktop 14. The cooktop 14 supports burners that are covered by grates 16 which support cooking vessels for surface cooking. The front of the range includes an oven covered by an oven door 18 with a viewing window 20 in the oven door 18. A handle 22 is mounted to the oven door 18 for user access to the oven. A control panel 24 is disposed between the oven door 18 and the cooktop 14. The control panel 24 is a generally planar portion of the range body having controls such as burner dials 26 mounted thereat for control of the cooktop 14 burners. In addition, indicator lamps, clocks, timers or other such electrically powered control elements may be mounted at or to the control panel 24.

While the range 10 is illustrated as a floor standing unit having an oven and cooktop, the present invention may also be adapted to a built-in cooktop and control panel assembly that mounts in cabinetry apart from an oven.

FIG. 1 includes a portion of the control panel 24 broken open to reveal the cross member 50 extending widthwise behind the control panel 24. The cross member 50 add stiffness and rigidity to the overall range structure in an area of user interactivity with the range. The range body 12 extends through height, width and depth dimensions to fill the three dimensional space in the cabinetry. Of concern to the present invention are the width and depth dimensions which give rise to width and depth directions, respectively. The width direction is indicated by an arrow W, while the depth direction is indicated by an arrow D.

The range 10 is mounted in freestanding manner in an opening between two kitchen cabinets which gives rise to a left cabinet CL and a right cabinet CR. When mounted for use, the range 10 typically has the sides completely covered by the left cabinet CL and the right cabinet CR. Therefore, any access to the side panels generally requires movement of the range 10 all the way out from the opening to expose the side panel so that the entire side panel can be removed.

Figure 2:
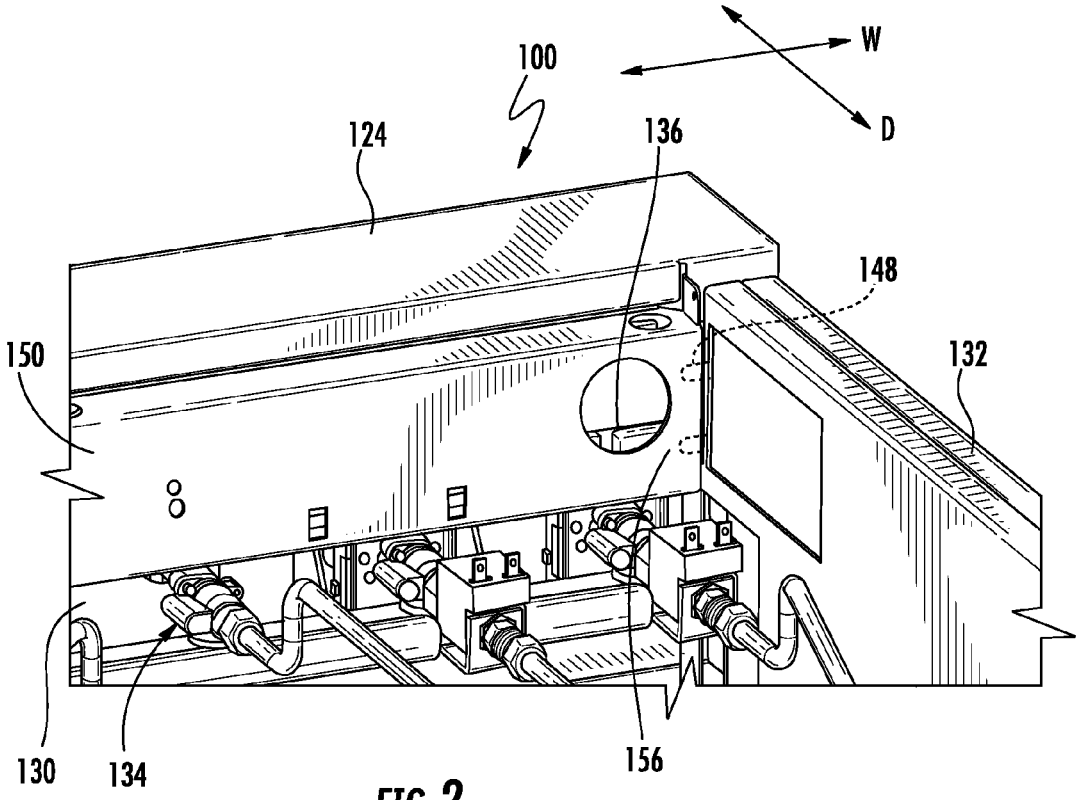
FIG. 2 PRIOR ART
FIG. 2 is a rear perspective view of a portion of a prior art range illustrating the prior mounting arrangement for the cross member.

Turning now to the FIG. 2, a prior art range is illustrated generally at 100 and includes a control panel 124 which may be similar to the present control panel. There, an internal chassis 130 supports internal control elements 134 having control element components 136 that are blocked from ready access by the cross member 150. A side panel 132 extends perpendicularly away from the control panel 124. The cross member 150 is mounted to the chassis 130 using fasteners 148 which may be screws or bolts. The end 156 of the cross member 150 is capped with a panel having fastener receiving openings formed therein to receive the fasteners 148 from a width direction W. The fasteners 148 extend in a widthwise orientation such that the heads or other portions instrumental in the removal and insertion of the fasteners is accessible from the side requiring that the side panel 132 be removed. As seen in the discussion above, such removal of the side panel 132 requires removal of the range from the opening in the cabinets.

Figure 3:
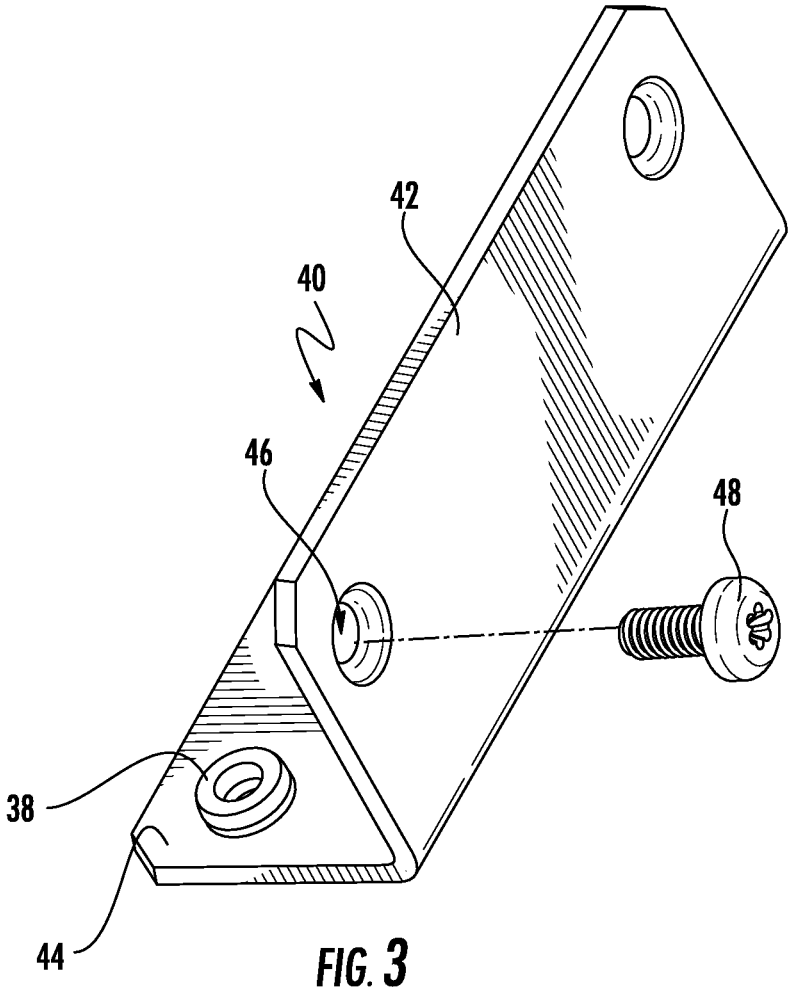
FIG. 3 is a perspective view of one of the brackets according to the present invention.
Figure 4:
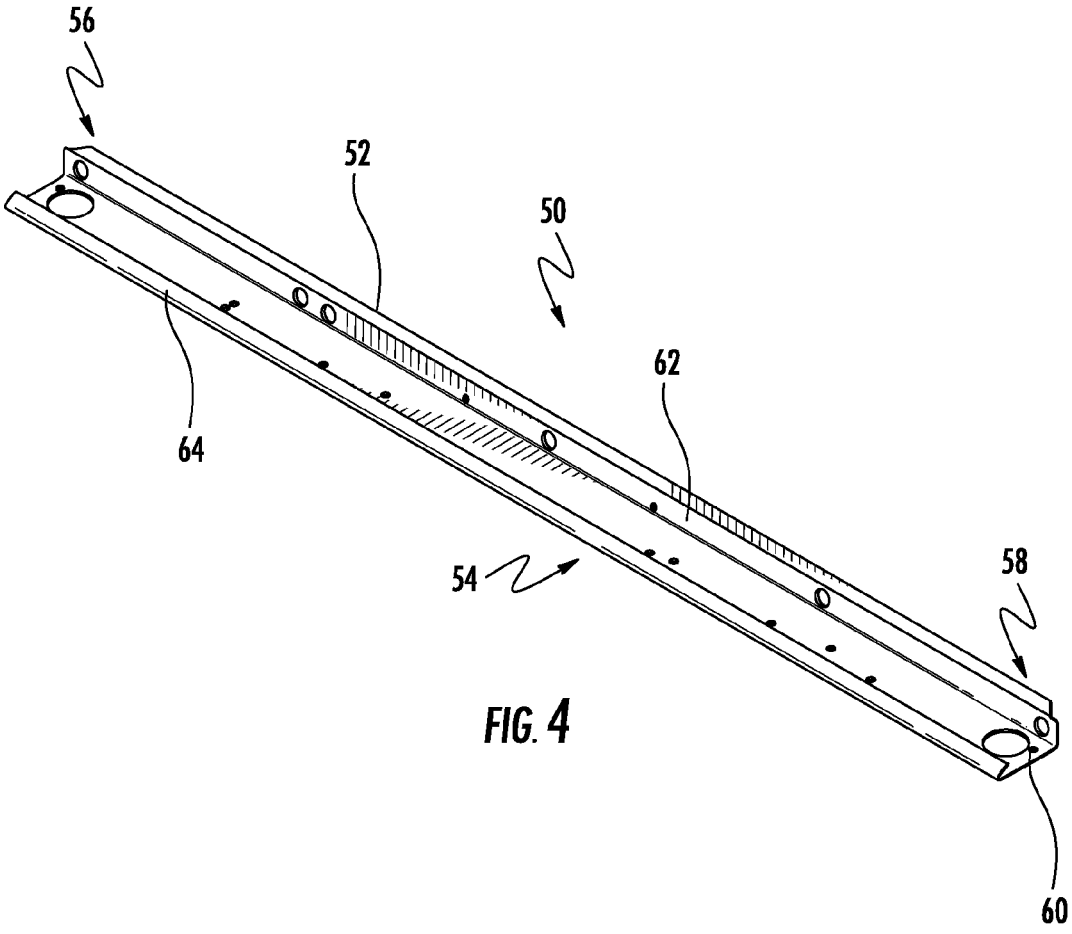
FIG. 4 is a perspective view of the cross member.
Figure 5:
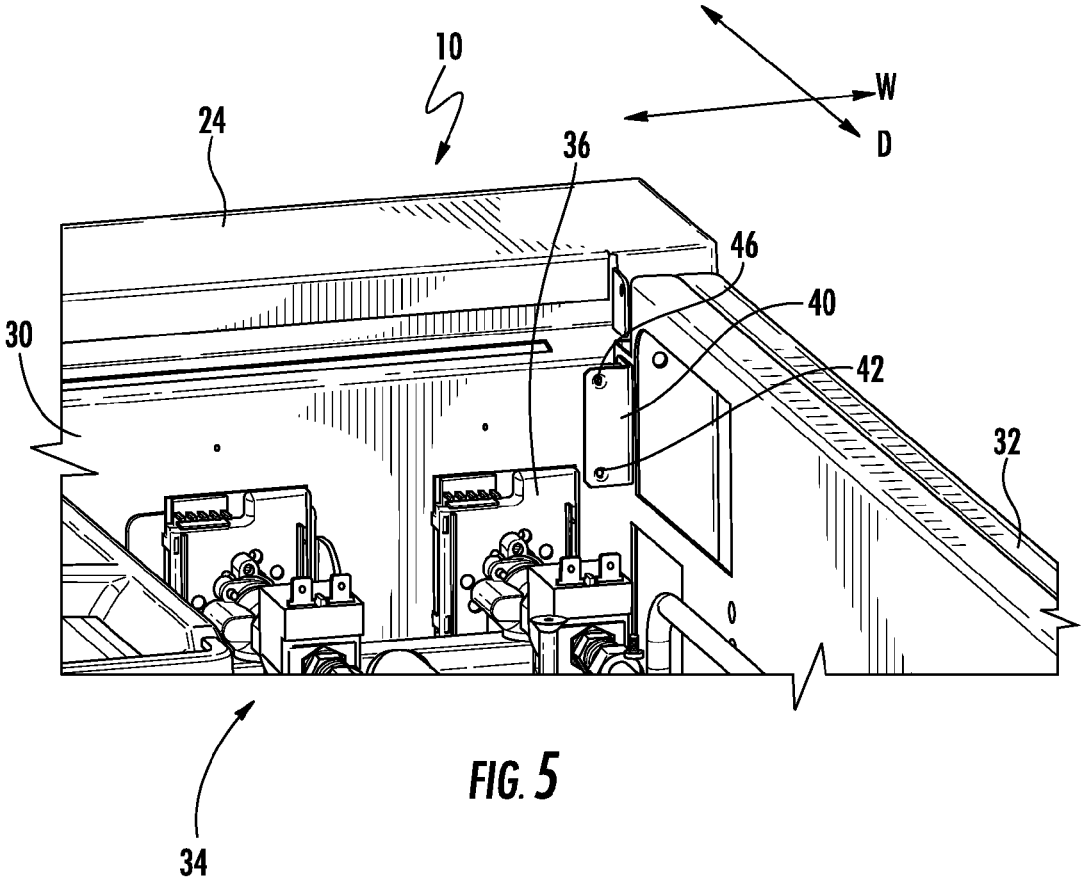
FIG. 5 is a rear perspective view of a range with a cross member removed illustrating the brackets of the present invention.
Figure 6:
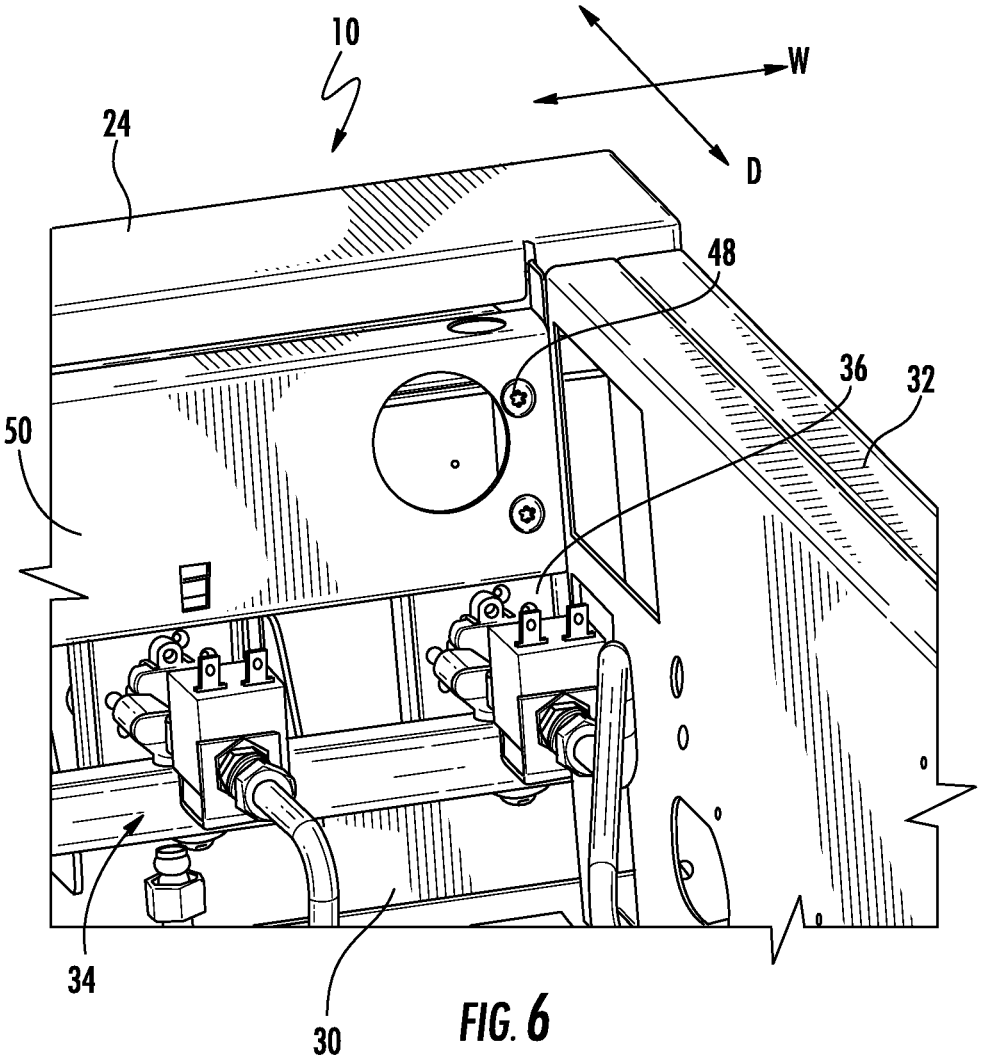
FIG. 6 is a perspective view of an internal portion of a range illustrating the present invention in use.

According to one preferred embodiment of the present invention, the range 10 includes a cross member 50 as seen in FIG. 4 and two mounting brackets, one of which is illustrated in FIG. 3 and mounted to the home appliance as illustrated in FIG. 5 and FIG. 6. Another preferred embodiment of the invention includes only two of the brackets 40 illustrated in FIG. 3 and the cross member 50 illustrated in FIG. 4. Since the present invention provides such an advantage to technicians in the field, the present invention is also set forth in the form of an assembly for retrofitting existing ranges.

It should be noted that the nature of the fasteners that attach the cross-member 50 as seen in FIG. 4 to the brackets 40 as seen in FIG. 3, may be any of a number of fasteners including screws, nuts and bolts, or quarter-turn fasteners with the common requirement that the fasteners be removable from a depth direction with respect to the range body.

As seen in FIG. 3, each of the brackets 40 is formed with a generally L-shaped cross section defining an outer wall 42 and an inner wall 44. The inner wall 44 is for mounting to the chassis while the outer wall 42 is for supporting the cross member 50. The inner wall 44 is fixed to the chassis using rivets 38. The outer wall 42 is formed with two fastener receiving bores 46 which may be threaded openings to accommodate a fastener 48 which may be a screw. The fastener receiving bores 46 face the depth direction D, as seen in FIG. 5. Alternately, the fastener receiving bores 46 may not be threaded and the faster 48 may be a bolt and nut assembly. Whatever fastener is chosen, the preferred fastener for ease of access is a screw 48.

Turning now to FIG. 4, the cross member is illustrated generally at 50 and includes a generally elongate body 52 having a generally planar front panel 54 to extend between the brackets 40 illustrated in FIG. 3. The cross-member body 52 includes first and second end portions 56, 58 formed in the front panel 54 with inturned walls 62, 64 extending along the width-wise dimension of the front panel 54. Fastener openings 60 are formed in the panel 54 at either end thereof 56, 58 in a manner for registry with the openings 46 in the brackets 40.

With reference to FIG. 5, the range accommodating the present invention is illustrated generally at 10. The brackets 40 are mounted to the chassis 30 using the aforesaid rivets (not seen in FIG. 5) with the inner wall (not seen in FIG. 5) being mounted in abutment with the chassis 30 adjacent the control panel 24. The outer wall 42 is presented for mounting the cross member 50 thereto using the fastener receiving bores 46. The side panel 32 remains in place. With the cross-member 50 away from the control panel 24, the control element components 36 of the control elements 34 are readily accessible for repair, removal or replacement.

As seen in FIG. 6, the cross member 50 is mounted to the brackets 40 using the fasteners 48. As may be appreciated, repair, removal or replacement of many of the control element components 36 is severely restricted or prohibited by the cross member 50, yet given the depth direction access to the fasteners 48 provided by the present invention, access to the control elements 34 is possible from a depth direction and does not require removal of the side panels 32, which means the range 10 can remain in the cabinet opening.

By the above, the present invention provides a home appliance, particularly a range, with improved serviceability. By providing depthwise access to fasteners holding a widthwise cross member over internal control elements, the cross member may be easily removed without removing the oven from its accommodation opening in the kitchen cabinets by eliminating the need for side panel removal.

It will therefore be readily understood by those persons skilled in the art that the present invention is susceptible of a broad utility and application. While the present invention is described in all currently foreseeable embodiments, there may be other, unforeseeable embodiments and adaptations of the present invention, as well as variations, modifications and equivalent arrangements, that do not depart from the substance or scope of the present invention. The foregoing disclosure is not intended or to be construed to limit the present invention or otherwise to exclude such other embodiments, adaptations, variations, modifications and equivalent arrangements, the present invention being limited only by the claims appended hereto and the equivalents thereof.

What is claimed is:

1. A home appliance comprising:

an appliance body defining a width direction and a depth direction;

a control panel located at a front portion of the appliance body and extending along the width direction, the control panel having a plurality of control element components mounted adjacent thereto, the control element components being at least one of mechanical control element components and electrical control element components;

a chassis within the body adjacent the control panel with the control element components mounted thereto;

a first bracket fixed to the chassis within the body adjacent the control panel, the first bracket having a first fastener portion fixed to the chassis and extending laterally away from the chassis with fastener element receiving openings aligned in the depth direction for receiving and retaining a removable fastener element;

a second bracket fixed to the chassis adjacent the control panel at a spacing from the first bracket, the second bracket having a second fastener portion fixed to the chassis and extending laterally away from the chassis with fastener element receiving openings aligned in the depth direction for receiving and retaining a removable fastener element; and a cross member extending in the width direction between the first bracket and the second bracket with control element components intermediate the cross member and the chassis, the cross member having a fastener bore at each widthwise end thereof aligned in the depth direction for registry with the fastener element receiving openings, the cross member being mounted to the first bracket using removable fastener elements aligned and driven in the depth direction through a fastener bore and a fastener receiving opening, and the second bracket using removable fastener elements aligned and driven in the depth direction through a fastener bore and a fastener receiving opening, wherein the removable fastener elements are insertable and removable from the depth direction.

2. The home appliance of claim 1 wherein the first bracket and the second bracket are fixed to the chassis using rivets.

3. The home appliance of claim 1 wherein the cross member is mounted to the first bracket and the second bracket using screws, the screws being aligned in the depth direction.

4. The home appliance of claim 1 wherein the first bracket is fixed to the chassis adjacent a first side of the appliance body and the second bracket is fixed to the chassis adjacent a second side of the appliance body wherein the cross member extends between the first side of the appliance body and the second side of the appliance body.

5. The home appliance of claim 4 wherein the cross member extends substantially the width of the control panel.

6. The home appliance of claim 1 wherein the first bracket and the second bracket are generally L-shaped in cross section, wherein the first bracket and the second bracket each include two wall portions attached along sides thereof with one wall portion extending parallel with the chassis and the other wall portion extending perpendicular to the chassis.

7. The home appliance of claim 1 wherein the first bracket and the second bracket each include two wall portions attached along sides thereof with one wall portion abutting the chassis and the other wall portion having the cross member mounted thereto.

8. The home appliance of claim 7 wherein the first bracket and the second bracket wall portions each include one wall portion aligned in the depth direction and the other wall portion aligned in the width direction.

9. The home appliance of claim 8 wherein a first fastener element receiving opening is formed on the wall portion of the first bracket aligned in the width direction.

10. The home appliance of claim 8 wherein a second fastener element receiving opening is formed on the wall portion of the second bracket aligned in the width direction.

11. The home appliance of claim 1 wherein the cross member is generally planar.

12. A range comprising:

a range body defining a width direction and a depth direction;

a control panel located at a front portion of the appliance body and extending along the width direction, the control panel having a plurality of control element components mounted adjacent thereto, the control element components being at least one of mechanical control element components and electrical control element components;

a chassis within the body adjacent the control panel with the control element components mounted thereto;

a first bracket fixed to the chassis within the body adjacent the control panel, the first bracket having a first fastener portion fixed to the chassis and extending laterally away from the chassis with fastener element receiving openings aligned in the depth direction for receiving and retaining a removable fastener element;

a second bracket fixed to the chassis adjacent the control panel at a spacing from the first bracket, the second bracket having a second fastener portion fixed to the chassis and extending laterally away from the chassis with fastener element receiving openings aligned in the depth direction for receiving and retaining a removable fastener element; and a cross member extending in the width direction between the first bracket and the second bracket with control element components intermediate the cross member and the chassis, the cross member having a fastener bore at each widthwise end thereof aligned in the depth direction for registry with the fastener element receiving openings, the cross member being mounted to the first bracket using removable fastener elements aligned and driven in the depth direction through a fastener bore and a fastener receiving opening, and the second bracket using removable fastener elements aligned and driven in the depth direction through a fastener bore and a fastener receiving opening, wherein the removable fastener elements are insertable and removable from the depth direction.

13. The range of claim 12 wherein the first bracket and the second bracket are fixed to the chassis using rivets.

14. The range of claim 12 wherein the cross member is mounted to the first bracket and the second bracket using screws, the screws being aligned in the depth direction.

15. The range of claim 12 wherein the first bracket is fixed to the chassis adjacent a first side of the range body and the second bracket is fixed to the chassis adjacent a second side of the range body wherein the cross member extends between the first side of the range body and the second side of the range body.

16. The range of claim 15 wherein the cross member extends substantially the width of the control panel.

17. The range of claim 12 wherein the first bracket and the second bracket are generally L-shaped in cross section, wherein the first bracket and the second bracket each include two wall portions attached along sides thereof with one wall portion extending parallel with the chassis and the other wall portion extending perpendicular to the chassis.

18. The range of claim 12 wherein the first bracket and the second bracket each include two wall portions attached along sides thereof with one wall portion abutting the chassis and the other wall portion having the cross member mounted thereto.

19. The range of claim 18 wherein the first bracket and the second bracket wall portions each include one wall portion aligned in the depth direction and the other wall portion aligned in the width direction.

20. The range of claim 19 wherein a first fastener element receiving opening is formed on the wall portion of the first bracket aligned in the width direction.

21. The range of claim 19 wherein a second fastener element receiving opening is formed on the wall portion of the second bracket aligned in the width direction.

22. The range of claim 12 wherein the cross member is generally planar.

23. A cross member assembly for mounting to a home appliance having an appliance body defining a width direction and a depth direction; a control panel located at a front portion of the appliance body and extending along the width direction, the control panel having a plurality of control element components mounted adjacent thereto, the control element components being at least one of mechanical control element components and electrical control element components;

a chassis within the body adjacent the control panel with the control element components mounted thereto;

a first bracket fixed to the chassis within the body adjacent the control panel, the first bracket having a first fastener portion fixed to the chassis and extending laterally away from the chassis with fastener element receiving openings aligned in the depth direction for receiving and retaining a removable fastener element;

a second bracket fixed to the chassis adjacent the control panel at a spacing from the first bracket, the second bracket having a second fastener portion fixed to the chassis and extending laterally away from the chassis with fastener element receiving openings aligned in the depth direction for receiving and retaining a removable fastener element; and a cross member extending in the width direction between the first bracket and the second bracket with control element components intermediate the cross member and the chassis, the cross member having a fastener bore at each widthwise end thereof aligned in the depth direction for registry with the fastener element receiving openings, the cross member being mounted to the first bracket using removable fastener elements aligned and driven in the depth direction through a fastener bore and a fastener receiving opening, and the second bracket using removable fastener elements aligned and driven in the depth direction through a fastener bore and a fastener receiving opening, wherein the removable fastener elements are insertable and removable from the depth direction.

24. The cross member assembly of claim 23 wherein the first bracket and the second bracket are generally L-shaped in cross section.

25. The cross member assembly of claim 24 wherein the first bracket and the second bracket each include two wall portions attached along sides thereof with one wall portion abutting the chassis and the other wall portion having the cross member mounted thereto.

26. The cross member assembly of claim 25 wherein the first bracket and the second bracket wall portions each include one wall portion aligned in the depth direction and the other wall portion aligned in the width direction.

27. The cross member assembly of claim 26 wherein a first fastener element receiving opening is formed on the wall portion of the first bracket aligned in the width direction.

28. The cross member assembly of claim 26 wherein a second fastener element receiving opening is formed on the wall portion of the second bracket aligned in the width direction.

29. The cross member assembly of claim 23 wherein the first bracket and the second bracket are generally L-shaped in cross section, wherein the first bracket and the second bracket each include two wall portions attached along sides thereof with one wall portion extending parallel with the chassis and the other wall portion extending perpendicular to the chassis.

* * * * *